US007312590B1

(12) United States Patent
Kovach, II et al.

(10) Patent No.: US 7,312,590 B1
(45) Date of Patent: Dec. 25, 2007

(54) MODEL RAILROAD VELOCITY CONTROLLER

(75) Inventors: Louis G. Kovach, II, Belleville, MI (US); Neil P. Young, Redwood City, CA (US)

(73) Assignee: The Creative Train Company, LLC, Beverly Hills, CA (US)

( * ) Notice: Subject to any disclaimer, the term of this patent is extended or adjusted under 35 U.S.C. 154(b) by 10 days.

(21) Appl. No.: 10/723,460

(22) Filed: Nov. 26, 2003

(51) Int. Cl.
*H02P 1/00* (2006.01)

(52) U.S. Cl. ..... 318/268; 318/603; 318/605; 318/661; 318/461; 246/187 A; 104/300; 446/454

(58) Field of Classification Search ..... 246/4, 246/187 A, 182 R; 104/DIG. 1; 191/22 R; 446/454–456, 431; 318/16, 268
See application file for complete search history.

(56) References Cited

U.S. PATENT DOCUMENTS

| | | | | |
|---|---|---|---|---|
| 4,352,010 | A * | 9/1982 | Koogler | 377/45 |
| 4,408,172 | A * | 10/1983 | Perdue | 334/11 |
| 5,441,223 | A * | 8/1995 | Young et al. | 246/4 |
| 5,749,547 | A * | 5/1998 | Young et al. | 246/4 |
| 5,954,584 | A * | 9/1999 | Yagi | 463/60 |
| 5,994,853 | A * | 11/1999 | Ribbe | 318/16 |
| 6,179,105 | B1 * | 1/2001 | Haass | 191/22 R |
| 6,255,798 | B1 * | 7/2001 | Obara et al. | 318/802 |
| 6,390,883 | B1 * | 5/2002 | Choi | 446/436 |
| 6,465,772 | B1 * | 10/2002 | Nelson et al. | 250/231.15 |
| 6,529,139 | B1 * | 3/2003 | Behun et al. | 446/456 |
| 6,534,948 | B2 * | 3/2003 | Ohura et al. | 318/798 |
| 6,619,594 | B2 * | 9/2003 | Wolf et al. | 246/187 A |
| 6,655,640 | B2 * | 12/2003 | Wolf et al. | 246/167 R |
| 6,686,911 | B1 * | 2/2004 | Levin et al. | 345/184 |
| 6,828,747 | B2 * | 12/2004 | Endo et al. | 318/560 |
| 6,864,879 | B2 * | 3/2005 | Nojima et al. | 345/156 |
| 6,900,793 | B2 * | 5/2005 | Goh et al. | 345/164 |
| 6,956,558 | B1 * | 10/2005 | Rosenberg et al. | 345/156 |
| 2002/0046675 | A1 * | 4/2002 | Young | 104/295 |
| 2003/0103044 | A1 * | 6/2003 | Sunda et al. | 345/184 |
| 2003/0211832 | A1 * | 11/2003 | Inokoshi et al. | 455/73 |
| 2004/0032395 | A1 * | 2/2004 | Goldenberg et al. | 345/156 |
| 2004/0056624 | A1 * | 3/2004 | Hayasaka | 318/560 |

OTHER PUBLICATIONS

CUI, Inc., "Panel/PCB Mount—High Resolution," CUI, Inc, Beaverton, OR, Jul. 2002, 1 page total.

(Continued)

*Primary Examiner*—Lincoln Donovan
*Assistant Examiner*—Renata McCloud

(57) ABSTRACT

Control over velocity of a model train may be determined based upon the speed of rotation of a control knob. A processor receives electronic pulses indicating rotation of the knob beyond a predetermined increment of angular distance. The processor calculates the amount of power ultimately conveyed to the model train based not only upon the number of pulses received, but also upon the elapsed time between these pulses. The shorter the elapsed time between pulses, the greater the change in power communicated to the train. Initially, a user can rapidly rotate the knob to attain coarse control over a wide range of velocities, and then rotate the knob more slowly to achieve fine-grained control over the coarse velocity. Utilizing the control scheme in accordance with embodiments of the present invention, in a compact and uninterrupted physical motion, a user can rapidly exercise both coarse and fine control over velocity of a model train.

6 Claims, 7 Drawing Sheets

OTHER PUBLICATIONS

"DCS Command Systems User's Guide Version 2.2," MTH Electric Trains Columbia, MD (no date) 10 pages total.
"Trainmaster® Command, The complete guide to command control," Lionel Electric Trains, Chesterfield, MI (1995).
NCE Publications Department, Procab Manual, Version 1.3, Operation Manual, pp. 1-15, Mar. 2001.
NCE Corporation, Powerhouse, CAB-04p, Intermediate Cab Operation Manual, pp. 1-7, Mar. 2001.

* cited by examiner

MODEL RAILROAD VELOCITY CONTROLLER

BACKGROUND OF THE INVENTION

Model train systems have been in existence for many years. In the typical system, the model train engine is an electrical engine which receives power from a voltage which is applied to the tracks and picked up by the train motor. A transformer is used to apply the power to the tracks. The transformer controls both the amplitude and polarity of the voltage, thereby controlling the speed and direction of the train. In HO systems, the voltage is typically a DC voltage. In other systems, the voltage may be an AC voltage transformed from the 60 Hz line voltage available in a standard wall socket.

A variety of mechanisms are used to control velocity of model trains. In the traditional approach shown in FIG. 1, application of power to track 2 by transformer 4 is regulated by twisting a control knob 6 approximately 90°, from a zero power position 8 to a full power position 10.

FIG. 2 shows a simplified cut-away view of the internal components of the conventional transformer 4. Specifically, the control knob controls physical connection between a exposed windings 700 on the secondary side of transformer 4 and mechanical wiper 702 at connection point 705. When the knob 6 and wiper 702 are turned clockwise, wiper 702 allows additional winding 700 of the transformer to be connected on the secondary side of the transformer. This in turn increases the voltage and thus the power available to operate the model train.

When wiper 702 is located at zero position 703, no connection is made on the secondary side of the transformer, and thus no voltage is available to operate the locomotive. This comprises the stopped condition.

When wiper 702 is located at full power position 704, the largest number of turns on the secondary winding is the connection point, and thus all available voltage is supplied to model train. This constitutes the fastest velocity the train can travel.

At any position lying between the no connection point and the maximum number of connected windings, a portion of the maximum voltage will be output of the secondary side. The resolution of this control is determined by the number of secondary winding connections. In a typical transformer, the number of secondary winding connections is between about forty and eighty, over an angular range of knob positions of about 90°.

Conventionally, the power applied by transformer 4 to track 2 is increased as knob 6 is turned in the clockwise direction, and decreased as knob 6 is turned in the counter-clockwise direction. As illustrated in FIG. 1 control knob 6 is typically able to be turned approximately 90°, with the complete range of locomotive speed necessarily lying within this rotational arc.

In another type of control system, a coded signal is sent along the track, and addressed to the desired train, conveying a speed and direction. The train itself controls its speed, by converting the AC voltage on the track into the desired DC motor voltage for the train according to the received instructions.

These instructions can convey commands relating to other than train speed, including for example signals instructing the train to activate or deactivate its lights, or to sound its horn. U.S. Pat. Nos. 5,441,223 and 5,749,547 issued to Neil Young et al. show such a system and are incorporated by reference herein for all purposes. Due to this increase in complexity of model railroading layouts and equipment, it is desired to exercise more precise control over the velocity of locomotives.

For example, the above-incorporated control system utilizes a rotating control wheel to achieve higher resolution of train velocity. Such a control wheel allows continuous rotation in either direction with no fixed starting or stopping point. Such a rotating control wheel typically generates approximately fifty signals per revolution. Thus a particular system featuring a total resolution of two hundred speed steps would require four complete revolutions of the control wheel by the user to move from zero to full speed.

This conventional command control approach to regulating train velocity offers the advantage of conferring greater granularity over the control of velocity. This approach, however, requires that more physical effort be exerted by the user to turn the knob multiple times, in order to produce the same speed resulting from less than one twist of the knob of the device shown in FIG. 1.

This enhanced physical effort offers at least two disadvantages. First, the extra time required to rotate the knob an additional distance may delay responsiveness between train speed and the controller. Second, the required physical manipulation of the control knob over greater distances may strain the wrist tendons/ligaments of a user.

Accordingly, there is a need in the art for a model train velocity controller which allows the user to rapidly exercise precise control over a wide range of speeds.

BRIEF SUMMARY OF THE INVENTION

Control over velocity of a model train may be determined based upon the speed of rotation of a control knob. A processor receives an electronic pulse indicating rotation of the knob beyond a predetermined increment of angular distance. The processor calculates the amount of power ultimately conveyed to the model train based not only upon the number of pulses received, but also upon the elapsed time between these pulses. The shorter the elapsed time between pulses, the greater the change in power communicated to the train. Initially, a user can rapidly rotate the knob to attain coarse control over a wide range of velocities, and then rotate the knob more slowly to achieve fine-grained control over the coarse velocity. Utilizing the control scheme in accordance with embodiments of the present invention, in a compact and uninterrupted physical motion, a user can thus rapidly exercise both coarse and fine control over velocity of a model train.

An embodiment of a method in accordance with the present invention for controlling velocity of a model vehicle, comprises, providing a control wheel configured to rotate within a range of positions, and determining a speed of rotation of the control wheel. The magnitude of power provided to the model vehicle is correlated with a speed of rotation of the wheel.

An embodiment of an apparatus in accordance with the present invention for providing power to a model vehicle, comprises, a control wheel rotatable over a range of positions, a sensing element in communication with the control wheel and configured to detect a speed of rotation of the wheel, and a processor in electrical communication with the sensing element, the processor configured to correlate wheel rotational speed with a magnitude of power provided from a source to a model vehicle.

For further understanding of the nature and advantages of the invention, reference should be made to the following description taken in conjunction with the accompanying drawings.

DETAILED DESCRIPTION OF THE INVENTION

Figure 1:
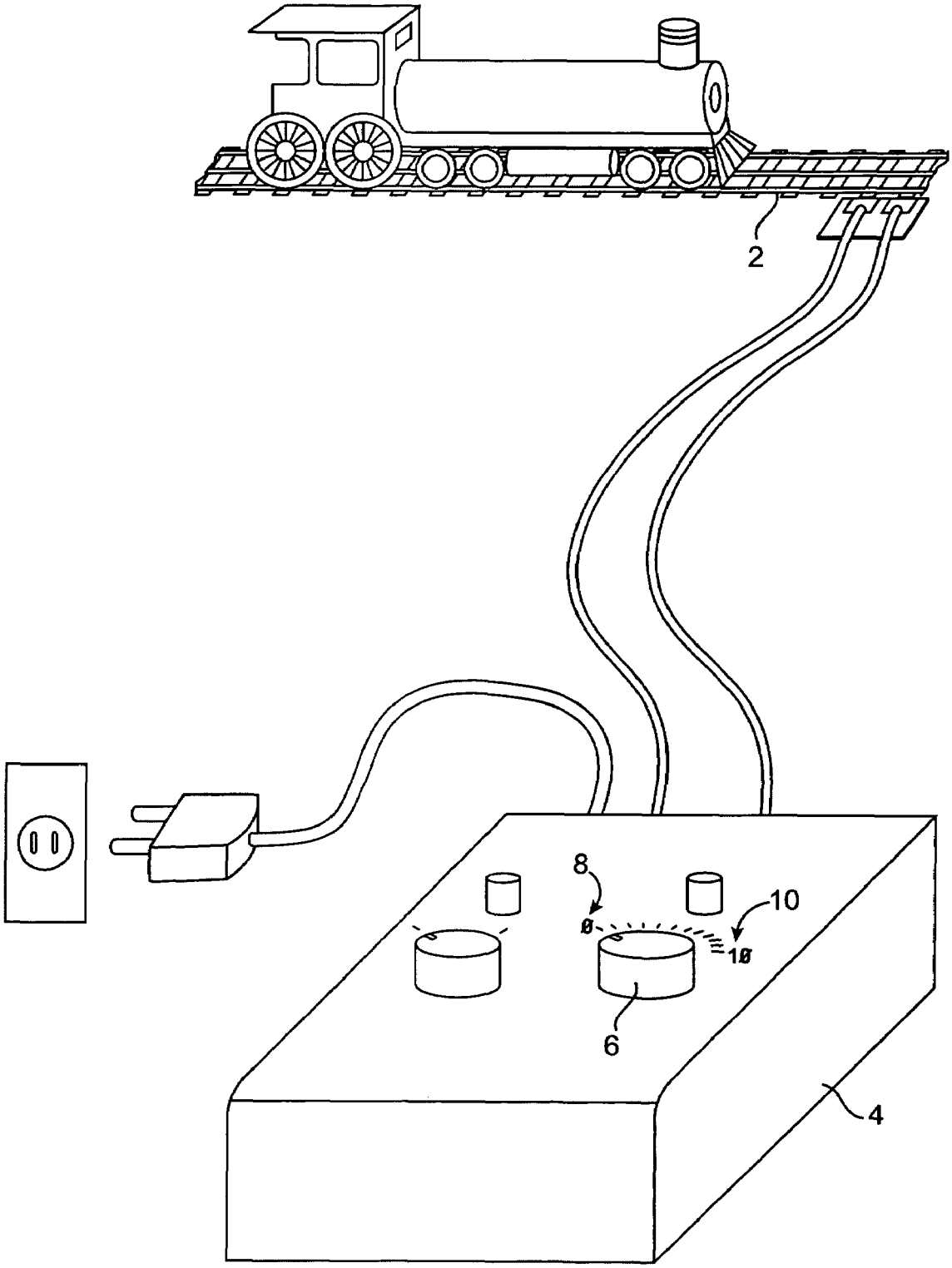
FIG. 1 (Prior Art)
FIG. 1 is a diagram of one conventional mechanism controlling velocity of a model train.
Figure 2:
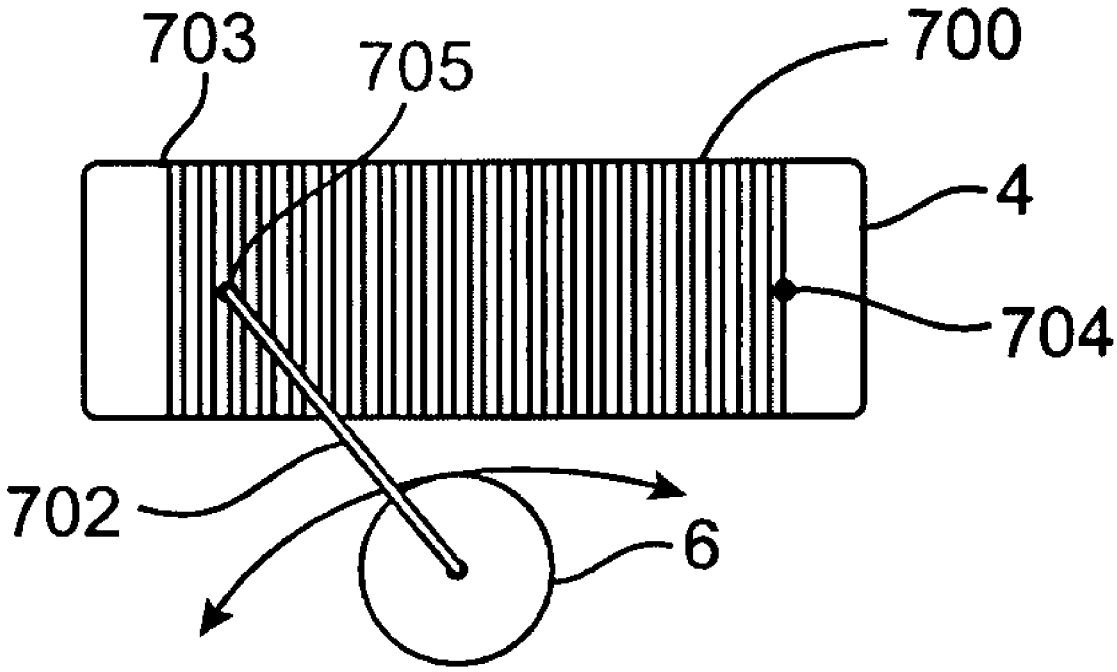
FIG. 2 (Prior Art)
FIG. 2 is a simplified cut-away view of components of the conventional mechanism shown in FIG. 1.
Figure 3A:
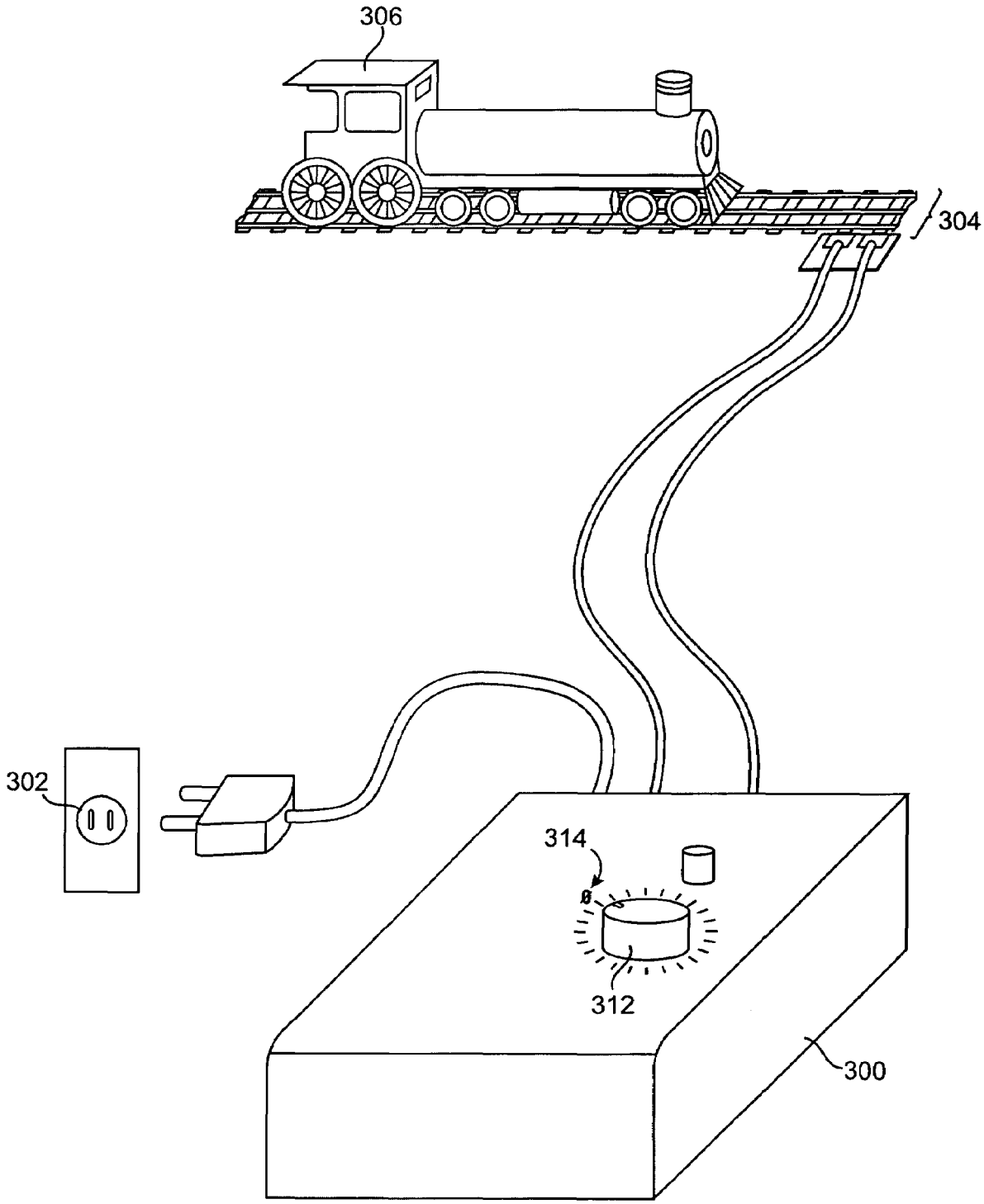
FIG. 3A is a diagram illustrating a mechanism controlling velocity of a model train in accordance with one embodiment of the present invention.

FIG. 3A is a perspective drawing of an example layout of a train track system incorporating velocity control in accordance with one embodiment of the present invention. Transformer 300 is in electrical communication with AC outlet 302 and with rails 304. Model train locomotive 306 runs on rails 304.

Transformer 300 includes control knob 312. Control knob 312 controls the magnitude of the power applied to rails 304, and may occupy a range of positions corresponding to a complete rotation of knob 312. Movement of knob 312 in a clockwise direction results in application of power resulting in forward movement of the model train. Movement of knob 312 in a counterclockwise direction results in application of power resulting in backward movement of the model train.

Figure 3C:
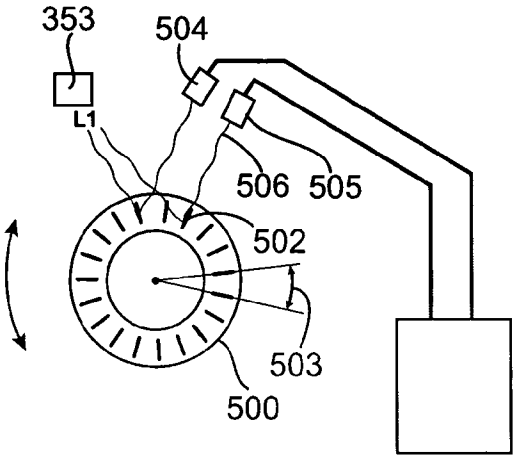
FIG. 3C is a simplified schematic diagram illustrating certain portions of another embodiment of the mechanism shown in FIG. 3A.
Figure 3D:
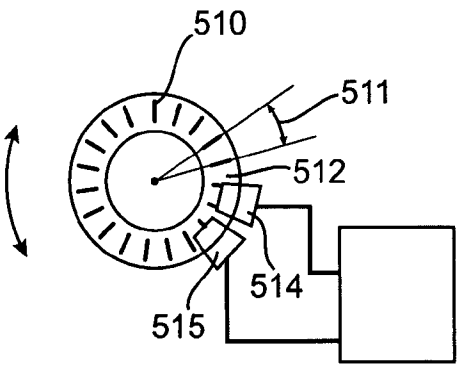
FIG. 3D is a simplified schematic diagram illustrating certain portions of still another embodiment of the mechanism shown in FIG. 3A.
Figure 3B:
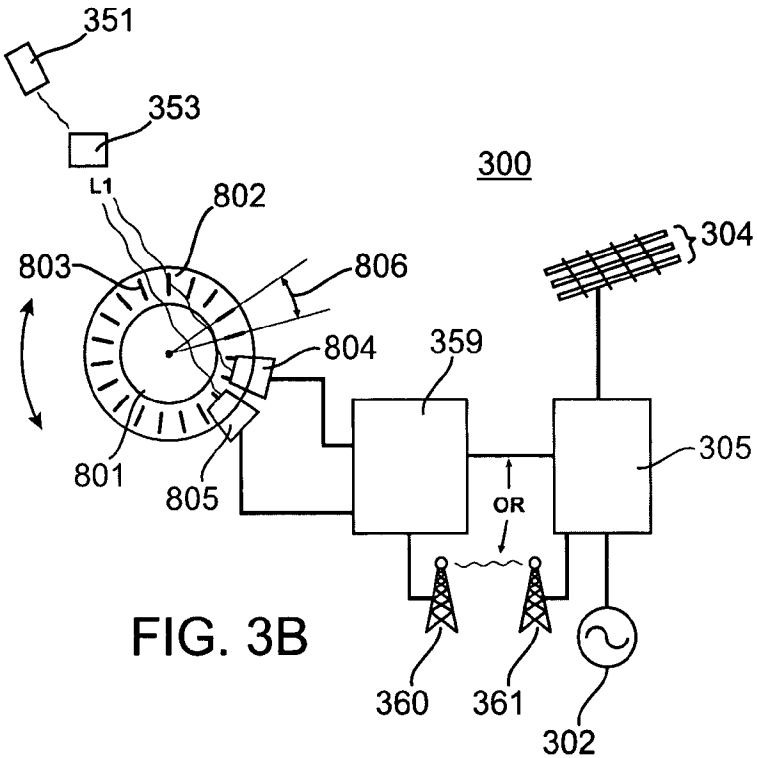
FIG. 3B is a simplified schematic diagram illustrating certain portions of one embodiment of the mechanism shown in FIG. 3A.

FIG. 3B is a block diagram illustrating certain portions of one possible embodiment of the mechanism shown in FIG. 3A. Alternating current power source 302 is in electrical communication with rails 304 through power regulator 305. Regulator 305 is in turn in electrical communication with, and controlled by, processor 359.

Processor 359 receives input from first optical detector 804 and from second optical detector 805. Control knob 312 is in rotatable communication with disk 802 having slots 803. Depending upon the rotational orientation of disk 802, slots 803 are spaced to selectively permit light transmitted from source 351 to reach one of detectors 804 and 805. Successful transmission of the light through a slot 803 results in the respective optical detector 804 and/or 805 generating a voltage pulse for receipt by processor 359.

Figure 5A:
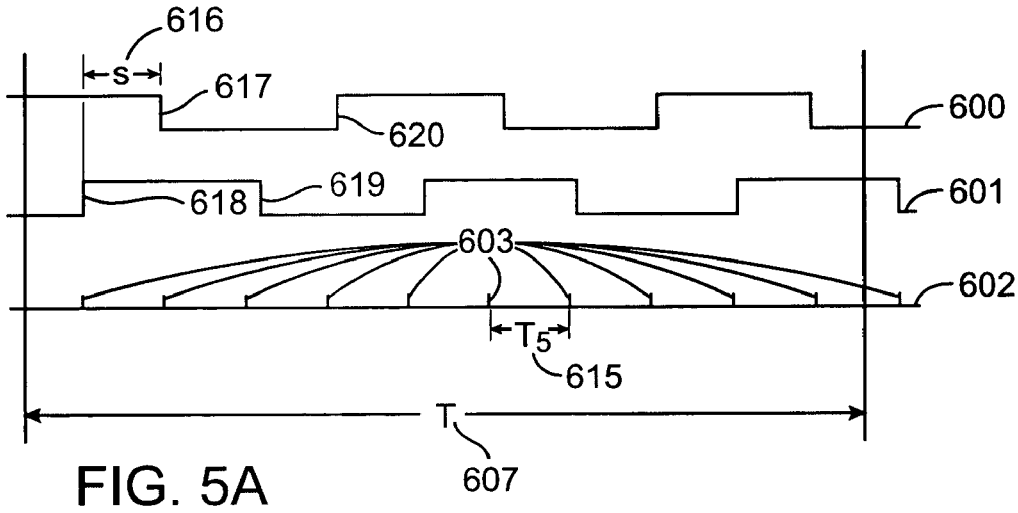
FIG. 5A plots the waveforms of electronic pulses received by a processor controlling train velocity according to a conventional approach.

Conventionally, a processor receiving such an electronic pulse changes the applied power based only upon the number of pulses. For example, FIG. 5A shows waveforms 600 and 601 of the electronic signals received by processor 359 from optical detectors 804 and 805, respectively, over a total time period T (607). Sample times 603 along axis 602 are generated on the rising edge 618 or 620 or the falling edge 617 or 619 of either wave 600 and 601. The optical detectors 804 or 805 generate an edge according to movement of the rotating wheel and disk over a predetermined angular distance, that allows the transmission of light through successive gaps.

Waveforms 600 and 601 exhibit 90° degree phase shift 616 relative to each other. This phase shift allows the direction of turning of the wheel and disk to be recovered from the pulses transmitted from the detectors to the processor.

In a conventional control scheme, an edge generates a signal for a single step velocity increase or decrease, based on the direction of rotation to the regulator, which is relayed to the model train. The velocity signal generated is limited to the number of edges comprising one complete revolution of the optical disk.

In order to provide for more fine-grained control over velocity control, it is possible to create an optical disk having more slots and therefore exhibiting a larger number of edges per revolution. Such a modified controller device, however, would exhibit a small angular distance between individual markings. This would cause difficulty in manipulating the device in order to accomplish a fine adjustment of train velocity.

Conversely, where angular distance between slots is increased to avoid this problem, a user would be forced to rotate the wheel more than one revolution in order to complete the entire speed range. In order to adjust speed to the same velocity over the same time, a user would be forced to rotate the wheel and disk more rapidly.

Figure 5B:
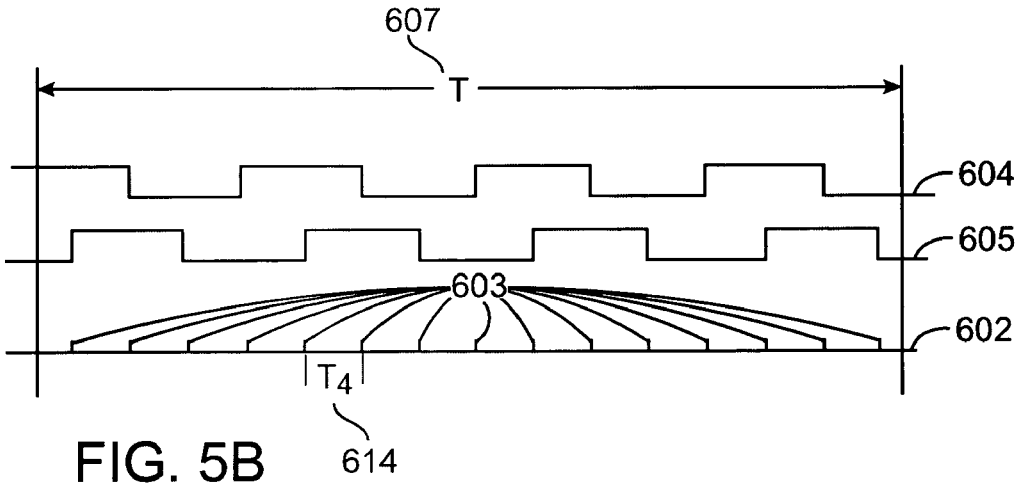
FIG. 5B plots the waveforms of electronic pulses received by a processor controlling train velocity according to a conventional approach.

This is shown in FIG. 5B, which plots waveforms 604 and 605 of the electronic signals received by the processor from optical detectors 804 and 805, respectively. As compared with FIG. 5A, a larger number of sample times 603 have been received along axis 602 over the same total time period T (607).

In accordance with embodiments of the present invention, control over velocity of a model train may be determined based upon the speed of rotation of a control knob. Specifically, processor 359 receives electronic pulses from optical detectors 804 and 805 that are in selective communication with optical source 351 through gaps 803 in an intervening optical disk 802. The gaps 803 in optical disk 802 are regularly spaced in predetermined increments 806 of angular distance.

Processor 359 receives the pulsed signals from elements 804 and 805, calculating therefrom the amount of power ultimately conveyed to the model train. This velocity calculation is based not only upon the number of pulses received, but also upon the elapsed time between these pulses. The shorter the elapsed time between pulses, the greater the power communicated to the train.

Figure 5C:
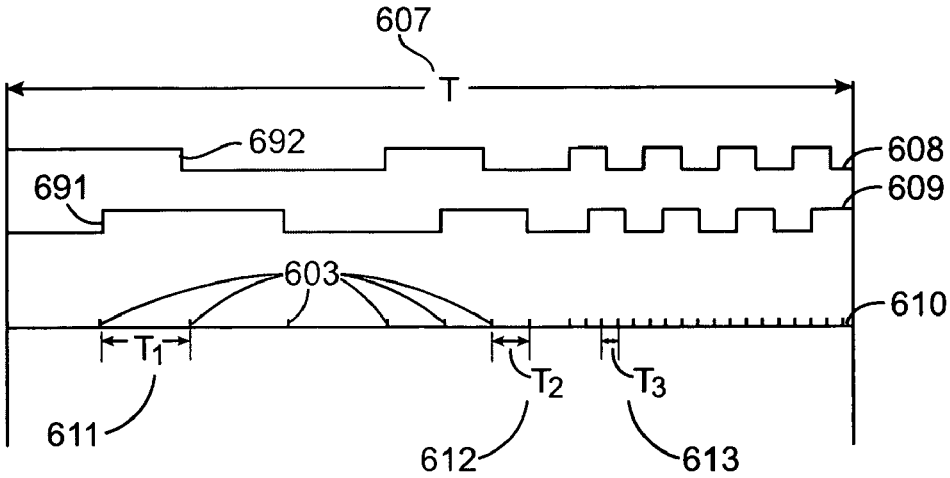
FIG. 5C plots the waveforms of electronic pulses received by a processor controlling train velocity according to an embodiment of the present invention.

FIG. 5C plots waveforms 608 and 609 of the electronic signals received by processor 359 from optical detectors 804 and 805, respectively, over a total time period T (607).

Sample times 603 along axis 610 are generated on the rising edge 691 or the falling edge 692 either wave 608 and 609. The optical detectors 804 or 805 generate an signal edge created by movement of the rotating wheel and disk over a predetermined angular distance.

Unlike the conventional approaches shown in FIGS. 5A and 5B, the number of pulses communicated to the processor, alone do not necessarily correspond to single steps of velocity increase or decrease. Specifically, edges of the electrical pulses initially communicated from the detectors are spaced by a time interval T1, and each edge corresponds to a single step change in velocity. Thus for time between edges of 611, the resulting speed calculation would be performed utilizing an equation with one pulse multiplied by a speed factor of one, resulting in a speed generation change of one. In the above example the output generated when the interpretation of the movement is slow, or fine control is required.

Later during time T, however, the edges of the electrical pulses communicated from detectors 804 and 805 are spaced by a shorter time interval T2 between edges at 612. Processor 359 receives these signals, and applies a multiplier factoring in knob speed, to in order produce the changed velocity. Thus the correlation between pulse edges received and changes in velocity steps will exceed a 1:1 ratio for the time interval T2. This time is shorter in duration, indicating the operator requires faster acceleration or deceleration of the train. The second example could evaluated as one pulse multiplied by a rotational speed factor of two, resulting in a change of two. This would allow the same number of slots to exist on the wheel, without requiring twice the movement.

Application of a multiplier to govern train velocity can occur over a range of control wheel rotation speeds. For example, in accordance with one embodiment of the present invention, rotation of the wheel at speeds corresponding to one full rotation in greater than 200 ms could result in a multiplication factor of one. Rotation of a full turn over a time of between about 100-200 ms could result in a multiplication factor of two, rotation of a full turn over a time of between about 50-100 ms could result in a multiplication factor of three, rotation of a full turn over a time of between about 25-50 ms could result in a multiplication factor of four, and rotation of a full turn over a time less than 25 ms could result in a multiplication factor of eight.

Still later during time T, the edges of the electrical pulses communicated from detectors 804 and 805 are spaced by an even shorter time interval T3 between edges at 613, T3<T2<T1. Processor 359 receives these signals, and applies an even greater multiplier to produce the changed velocity. Thus the correlation between pulse edges received and changes in velocity steps will exceed the ratio for the time interval T2.

In a third example, times 612 and 613 would could have a speed multiple factor of four and eight, respectively. Utilizing the former speed factor of four, a wheel conventionally generating fifty edges per revolution could output one hundred speed step changes within a wheel rotational arc of only 180°, or two hundred speed step changes within a wheel rotational arc of 360°. Utilizing the latter speed factor of eight would require only a half a complete turn of the control knob to complete the two hundred speed step command.

Initially, a user can rapidly rotate the knob to attain coarse control over a wide range of velocities, and then rotate the knob more slowly to achieve fine-grained control over the coarse velocity. Utilizing the control scheme in accordance with embodiments of the present invention, in a compact and uninterrupted physical motion, a user can rapidly exercise both coarse and fine control over velocity of a model train.

It is important to note that velocity adjustment in accordance with the present invention is operable both to achieve both acceleration and deceleration of a moving train. Thus movement of the control wheel in an opposite direction can rapidly and effectively reduce the amount of power provided to the locomotive, causing it to stop, and even accelerate in the reverse direction if necessary.

Although one specific embodiment has been described above, the present invention can be embodied in other specific ways without departing from the essential characteristics of the invention. Thus while FIGS. 3A-B show a controller wherein electrical pulses indicating rotation of the control wheel are generated utilizing transmission of an optical beam through a gap, this is not required by the present invention. Alternative embodiments in accordance with the present invention could utilize other ways of generating electrical pulses based upon rotation of a control wheel knob.

For example, rotation of a control knob over an angular distance could be detected through selective reflection, rather than transmission, of a light beam. In one such alternative embodiment shown in the simplified schematic drawing of FIG. 3C, a rotating disk 500 could bear reflecting portions 502 positioned at regular angular intervals 503 on its surface. Optical detectors 504 and 505 could sense passage of the reflecting portion by detection of the reflected light beam 506.

And while the above-referenced embodiments have focused on the use of optical principles to generate electronic pulses correlating to movement of the disk, this is also not required by the present invention. In accordance with still other alternative embodiment shown in the simplified schematic drawing of FIG. 3D, electrical pulses could be generated as magnetic elements 510 positioned at regular angular increments 511 on a surface of a disk 512 rotate past fixed magnetic sensors 514 and 515.

Figure 6A:
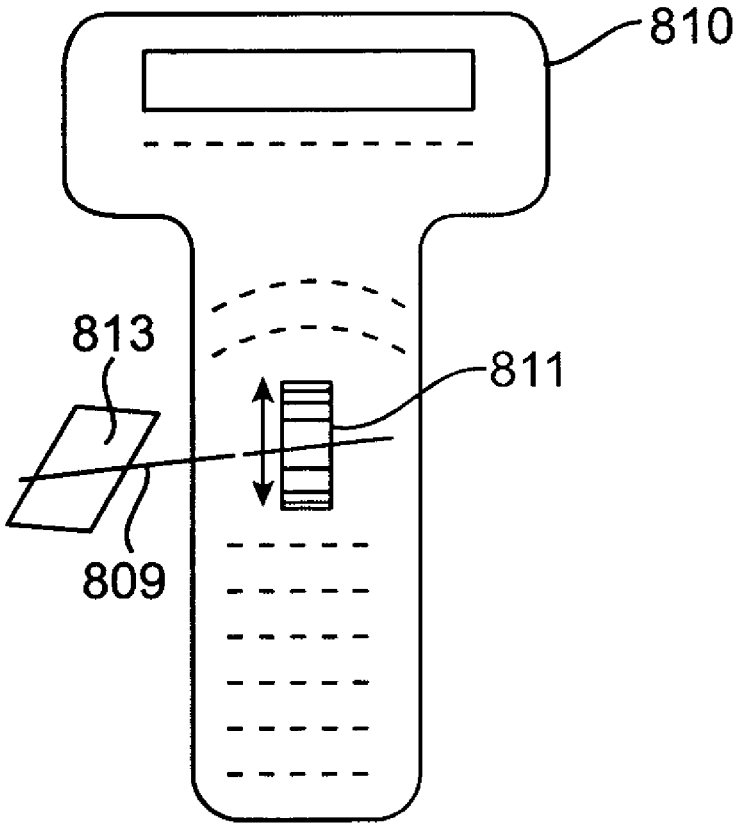
FIG. 6A shows a plan view of an alternative embodiment of a controller device.
Figure 6B:
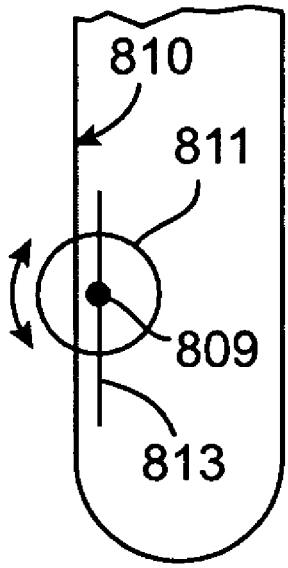
FIG. 6B shows a cross-sectional view of the controller device of FIG. 6A.

While FIGS. 3A-B depict a velocity controller wherein the control knob is rotatable about an axis perpendicular to the plane of the controller, this is not required by the present invention. FIGS. 6A and 6B show simplified plan and cross-sectional views respectively, of an alternative embodiment of a velocity controller in accordance with the present invention. Specifically, control wheel 811 is rotatable about axis 809 parallel to plane 813 of controller 810.

Moreover, the control knob and processor need not be housed in the same structure as the power regulator. In addition, the processor need not be in wired communication with the power regulator. In accordance with certain embodiments, the processor may be in wireless communication with the power regulator, as depicted in FIG. 3B with transmitting and receiving antennas 360 and 361 in wired communication with processor 359 and power regulator 305, respectively.

And while the specific embodiment described above causes greater power to be delivered by knob rotation beyond a threshold speed, this is not required by the present invention. In accordance with alternative embodiments, knob rotation below a recognized threshold speed may result in the application of greater or less power.

Moreover, while the specific embodiment of FIGS. 3A-B utilizes the same knob to control both train direction and speed, this is also not required by the present invention. In accordance with alternative embodiments, separate knobs could be utilized to control train direction and train speed.

In addition, the increasing complexity of track layouts and equipment utilized by model railroading hobbyists may feature more than one locomotive running on the same track. In such settings, it may be desired to independently exercise control over the velocity of each train. Accordingly, more advanced model railroading systems may include wireless interface devices allowing selective communication with different engines running along the same track.

Example Train Layout

Figure 4:
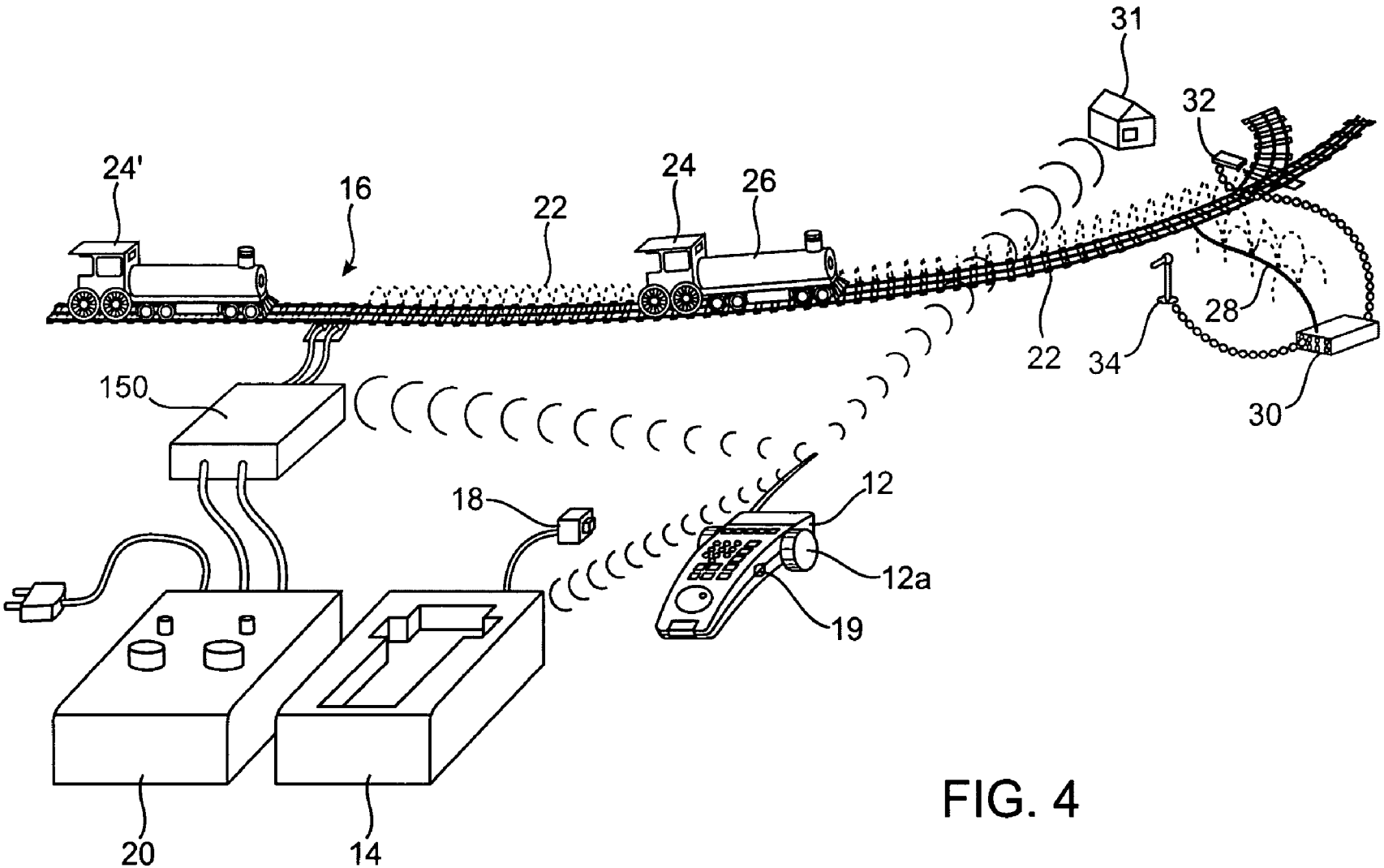
FIG. 4 is a diagram of a model train layout featuring more than one locomotive receiving power from the same set of tracks.

FIG. 4 is a perspective drawing of an example layout of an alternative train track system. A hand-held remote control unit 12 including control knob 12*a* is used to transmit signals to a base unit 14 and to a power master unit 150, both of which are connected to train tracks 16. Base unit 14 receives power through an AC adapter 18. A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Power master unit 150 modulates AC track power to the track 16 and also superimposes DC control signals on the track to control special effects and locomotive 24'. Locomotive 24' is, e.g., a standard Lionel locomotive powered by AC track power and receptive to DC control signals for, e.g., sound effects.

Base unit 14 transmits an RF signal between the track and earth ground, which generates an electromagnetic field indicated by lines 22 which propagates along the track. This field will pass through a locomotive 24 and will be received by a receiver 26 inside the locomotive an inch or two above the track. Locomotive 24 may be, e.g., a standard locomotive retrofitted or designed to carry a special receiver 26.

The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The use of both base unit 14 and power master unit 150 allows operation and control of several types of locomotives on a single track layout. Locomotives 24 which have been retrofitted or designed to carry receiver 26 are receptive to control signals delivered via base unit 14. Standard locomotives 24' which have not been retrofitted may be controlled using DC offset signals produced by power master unit 150.

The remote unit can transmit commands wirelessly to base unit 14, power master unit 150, accessories such as accessory 31, and could also transmit directly to train engines instead of through the tracks. Such transmission directly to the train engine could be used for newer engines possessing a wireless receiver, while older train engines would continue to receive commands through the tracks.

Remote unit 12 includes control knob 12*a* that is actuable in accordance with the present invention. Remote unit 12 also includes mechanism 19 for determining both the position and speed of rotation of control knob 12*a*, for example a wheel having spokes configured to selectively permit transmission of light along a pathway, as described above in connection with the Embodiment of FIGS. 3A-B.

When knob 12*a* of wireless interface device 12 is turned slowly, the location of the knob dictates the velocity of the selected locomotive. When, however, knob 12*a* of the wireless interface 12 is turned more rapidly, this rotational speed may dictate velocity of the selected locomotive.

While the specific embodiments described above relate to methods and apparatuses for controlling the velocity of model trains moving on a track, the present invention is not limited to this particular application. In accordance with alternative embodiments, the velocities of other types of model vehicles moving on a track could also be controlled, for example the speed of a slot car. The control mechanism in accordance with embodiments of the present invention is also not limited to controlling the velocities of tracked vehicles, but could also be utilized to exercise remote control over model vehicles such as boats and aircraft.

Accordingly, the foregoing description is intended to be illustrative, but not limiting, of the scope of the invention which is set forth in the following claims.

What is claimed is:

1. An apparatus for providing power to a model vehicle, the apparatus comprising:

a control knob configured to be rotated by a user over a range of positions;

a light source;

a sensing element in communication with the control knob and configured to detect a speed of rotation of the knob over a period of about 50 milliseconds or less, the sensing element comprising a first optical detector and a second optical detector;

a rotatable disk in communication with the knob and intervening between the light source and the first and second optical detectors, wherein the first and second optical detectors are positioned at different locations along an outer circumference of the disk; and a processor in electrical communication with the sensing element, the processor configured to (1) correlate knob rotational speed with a magnitude of power provided from a power source to a model vehicle by multiplying a distance of rotation of the knob by a factor based upon speed of knob rotation and (2) detect a direction of knob rotation based upon a phase difference between electrical signals produced from the first and second optical detectors.

2. The apparatus of claim 1, wherein the processor is configured to generate the factor proportional to the speed of knob rotation.

3. The apparatus of claim 1, wherein the rotatable disk comprises gaps spaced at regular angular increments to allow optical communication between the light source and the first and second optical detectors, wherein the processor is configured to detect knob rotation speed based upon a rate of changed transmission of light.

4. The apparatus of claim 1, wherein the rotatable disk comprises reflecting elements spaced at regular angular increments to allow optical communication between the light source and the detector, wherein the processor is configured to detect knob rotation speed based upon a rate of changed reflection of light.

5. The apparatus of claim 1 further comprising an antenna configured to allow the processor to communicate with the power source through a wireless signal.

6. The apparatus of claim 1 further comprising a wired communication link between the processor and the power source.

* * * * *